US005582192A

United States Patent [19]

Williams, III

[11] Patent Number: 5,582,192

[45] Date of Patent: Dec. 10, 1996

[54] METHOD AND APPARATUS FOR DIAGNOSING MECHANICAL PROBLEMS, PARTICULARLY IN CIGARETTE MAKERS

[75] Inventor: James G. Williams, III, High Point, N.C.

[73] Assignee: Lorillard Tobacco Company, New York, N.Y.

[21] Appl. No.: 343,666

[22] Filed: Nov. 22, 1994

[51] Int. Cl.[6] ..... A24C 5/14

[52] U.S. Cl. ..... 131/280; 131/84.1; 131/108

[58] Field of Search ..... 131/84.1, 84.4, 131/280, 108, 904, 905, 906, 908–910; 364/468, 474.19, 505, 508, 551.02

[56] References Cited

U.S. PATENT DOCUMENTS 4,697,603 10/1987 Steinhauer et al. ..... 131/108 X
4,926,886 5/1990 Lorenzen et al. ..... 131/905 X
5,125,418 6/1992 Siems ..... 131/906 X
5,132,897 7/1992 Allenberg .
5,170,358 12/1992 Delio .
5,230,316 7/1993 Ichihara et al. .

*Primary Examiner*—Jennifer Bahr
*Attorney, Agent, or Firm*—White & Case

[57] ABSTRACT

In a machine having rotating components, in which a substance is processed in continuous form, a sensor generates signals representative of the instantaneous supply rate of the substance at one or more selected locations in the machine. A processor performs a Fast Fourier Transform (FFT) analysis on such signals, to determine the amplitude harmonic value at each frequency over a spectrum of frequencies. The measured FFT values are compared to reference values at the corresponding frequencies in order to identify out-of-spec values and generate an error signal. Preferably also, the processor matches the frequency corresponding to the out-of-spec amplitude to a corresponding harmonic frequency value of one of the rotating machine components.

21 Claims, 4 Drawing Sheets

METHOD AND APPARATUS FOR DIAGNOSING MECHANICAL PROBLEMS, PARTICULARLY IN CIGARETTE MAKERS

FIELD OF THE INVENTION

The present invention relates to machinery for making articles in which an element used to make the product is supplied as a continuous stream of material. The invention has particular application to cigarette makers, in which the machine forms loose tobacco into a continuous stream in order to make a cigarette rod.

BACKGROUND OF THE INVENTION

Cigarette manufacturing has become a highly automated operation with tremendous effort going into the areas of efficiency and product quality. Cigarette making machines have been developed to operate at increasingly high-speeds, with machines now capable of running at production rates of up to 14,000 cigarettes per minute. However, as machine speeds have increased, it has become increasingly difficult to maintain product uniformity and high quality, because at such speeds even small variations in machine performance can alter the composition of the final product.

In order to maintain quality control, it is currently the practice to monitor certain properties of the final product. A number of product measurements are normally made, such as cigarette rod density, and compared to preestablished limits. If data values exceed the limits established, the diagnostic processor compiles a listing which is evaluated by personnel to attempt to determine the cause of the out-of-spec condition and what corrective action is needed.

In addition to monitoring the quality of the final product, it is also the practice to monitor the machine to ensure that it is operating normally. The state-of-the-art method for monitoring the operation of the machine involves the use of vibrational analysis.

In a typical vibration analysis diagnostic system, a frequency reference disk file is established which stores various frequencies of interest and amplitude limits. The frequencies of interest are based on the RPM harmonics of the major rotating and moving parts of the machine, as well as higher order vibrational frequencies. Amplitude limits are assigned to all frequencies and frequency ranges of interest based on data from the machine manufacturers, testing, and historical data.

When the machine is operating, vibration measurements are made at key locations on the machine using accelerometers and/or velocity transducers. The signals are then analyzed, using a Fast Fourier Transform ("FFT") analysis, to determine their harmonic frequencies. The theory of Fourier Frequency Analysis very basically is that a complex time domain wave form can be represented as a sum of individual sine waves. The application of this technique to the amplitude-versus-time wave produced by machines having multiple rotating parts results in a determination of the vibrational amplitude at various frequencies.

Each harmonic or range of harmonics in each sensor frequency spectrum is compared to the limit information in the frequency reference file. If one or more amplitudes exceed the limit for the respective frequency, a list of harmonic amplitude values and/or graph of the harmonic spectrum is generated, along with the parts which have corresponding harmonic frequencies. The spectral information is then interpreted by maintenance personnel or expert systems software to isolate the exact mechanical problem.

Vibrational analysis techniques provide frequency information concerning the condition of the various mechanical parts which generate the vibration, e.g., motors, bearings, component imbalance and misalignment, and component failures and impending failures can be identified using these techniques. However, such techniques do not provide quantitative information on the effect of the mechanical components on the tobacco stream. A mechanical component in the cigarette maker can exhibit a normal vibrational spectra and, through mis-adjustment, still adversely affect the tobacco stream. This condition is especially apparent in the cigarette maker hopper section due to the many rotating components involved in feeding the tobacco.

Similarly, measuring the properties of the product output does not provide sufficient information about the interrelated effects of mechanical parts on the manufacturing process, i.e., the tobacco stream, to optimize the rod making performance of cigarette makers.

SUMMARY OF THE INVENTION

The present invention is a micro-computer based system for the purpose of monitoring, analyzing and baselining the interrelated effects of rotating or moving mechanical parts in a machine and a product output. The system provides maintenance personnel with quantitative diagnostic information concerning the source or sources of any abnormal variation in the product. The system enhances the ability to optimize and maintain the efficiency and quality output of the machine.

The invention will be described in relation to machinery for making cigarettes. In a cigarette maker, a tobacco stream is formed into a rod and wrapped by cigarette paper. The tobacco stream is formed from loose tobacco and continuously manipulated in the maker by a multitude of rotating and moving mechanical components.

Ideally, the net result of all this manipulation would be the production of a cigarette in which the tobacco rod has a constant weight-per-unit-length and circumference. Of course, because the tobacco rod is composed of individual pieces of cut tobacco, there would be small variations in density along the rod, but the distribution of such variations in tobacco density should be random.

The applicant has found, however, that even when the maker is operating normally, the variations in density along the rod are not random. To the contrary, the density of the passing tobacco stream varies with a characteristic frequency which is a function of the underlying frequencies of the various rotating components responsible for supplying tobacco to form the rod. In other words, the mechanical moving components influence the stream to the extent that they leave a frequency signature in the tobacco stream corresponding to the component's rotations RPM or period of movement.

The diagnostic system according to the present invention correlates directly the effect of the rotating mechanical parts of the maker on the quality of the output product, using a Fast Fourier Transform frequency analysis technique. Rather than performing an FFT analysis on machine vibration, however, the FFT analysis is performed on the measurements of tobacco weight.

In an exemplary embodiment, 2048 data points are used for each analysis. The 2048 point FFT's yield frequency spectra consisting of 1024 harmonics covering a range of 166.666 hertz with a frequency resolution of 0.163 hertz. Variation in the tobacco stream is indicated in the spectra at the frequencies which collectively make up the variation. The amplitude of each frequency harmonic corresponds directly to the amount each harmonic contributes to the variation. In the case of the tobacco density signal, the amplitude of each harmonic indicates an amount of variation in the tobacco stream at a certain frequency expressed in milligrams of tobacco.

Traditional measurements of tobacco rod variation, e.g., standard deviation or variance in tobacco density, only provide an indication of overall variation. With the variation in the tobacco stream expressed in the frequency domain, it becomes much more evident that there are usually multiple contributors to the total variation. With the frequencies of variation known, mechanical system design specifications can be consulted to locate the mechanical components operating at the offending frequencies.

For a better understanding of the invention, reference is made to the following detailed description of a preferred embodiment, taken in conjunction with the drawings accompanying the application.

DETAILED DESCRIPTION OF A PREFERRED EMBODIMENT

Figure 1:
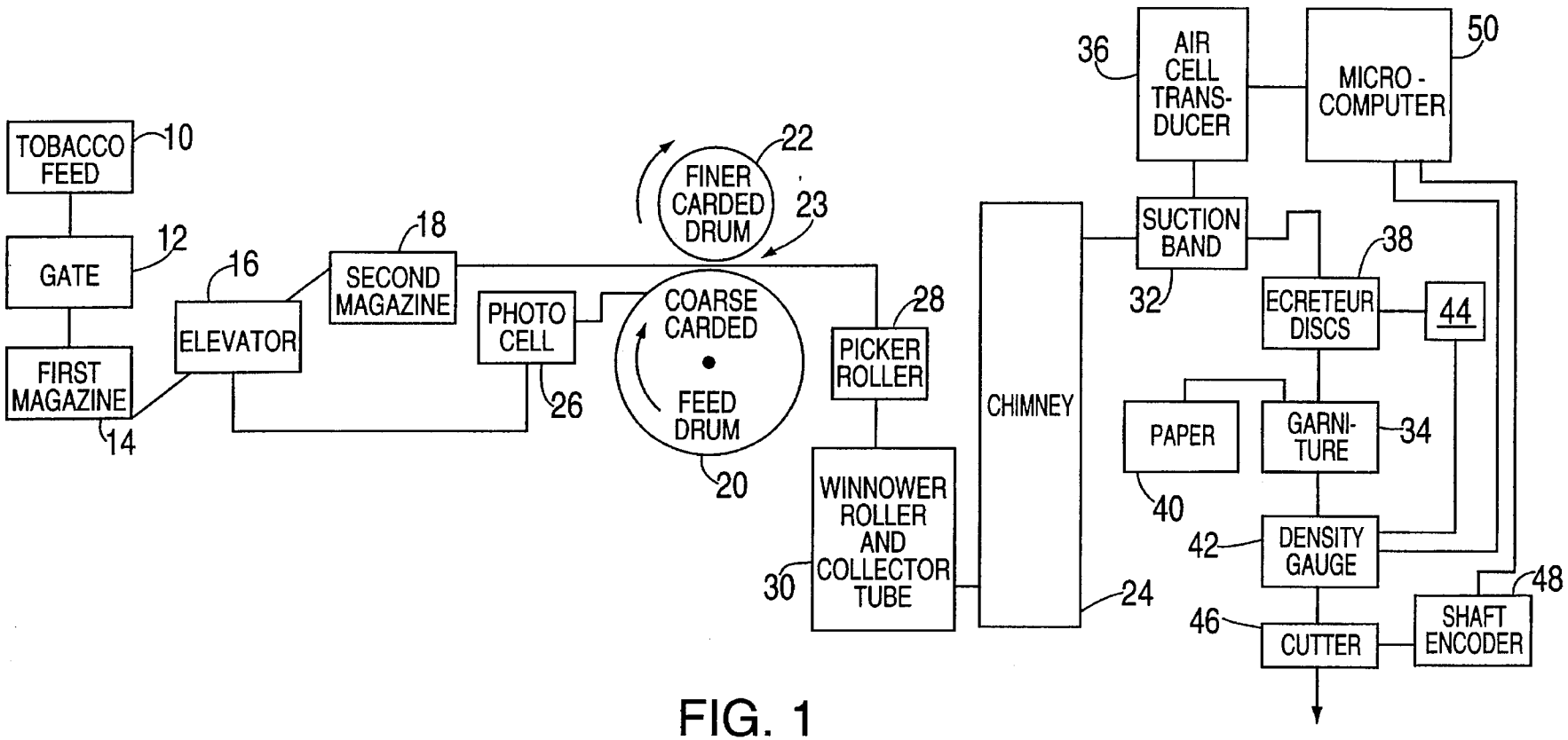
FIG. 1 is a block diagram of a cigarette maker illustrating one embodiment of the present invention.

The basic operation of a cigarette maker is well known and is shown generally in FIG. 1. Tobacco is delivered automatically by means of an overhead pneumatic feed system 10 to a gate 12 which is opened at required intervals to deliver batches of cut tobacco into the first magazine 14 of a hopper. Tobacco is then transferred out of the first magazine 14 by a two-speed carded band elevator 16, after which it falls into a second magazine 18. The tobacco is carried from the second magazine 18 by a coarse carded feed drum 20 until it meets a finer carded drum 22, which is rotating in the same direction. A gap 23 exists between the two carded drums which allows a regulated quantity of tobacco to pass between the carded drums 20, 22. The remaining tobacco, which collects upstream of the gap 23, is formed into a roll by the rotating action of the carded drums.

The size of the tobacco roll is monitored by a photoelectric cell 26 and controlled by the tobacco delivery rate of the two-speed elevator. When the roll is of sufficient size, it blocks the photocell 26 and the elevator runs at normal speed. When the size of the tobacco roll diminishes, indicating insufficient tobacco feed, the photocell 26 is actuated, causing the two-speed elevator 16 to switch from normal speed to high speed, which increases the rate of tobacco delivery to the carded feed drum 20. When the size of the tobacco roll returns to normal, the photocell is again blocked and the elevator speed returns to normal.

Tobacco which passes through the gap 23 between the carded feed drums 20, 22 is removed by a picker roller 28 and passes under a winnower roller and a collector tube 30, after which it is carried up the tobacco chimney 24 by an air stream and onto a perforated tobacco suction band 32.

The tobacco is held by suction to the underside of the tobacco suction band 32 and conveyed toward a garniture 34. The depth of the tobacco on the suction band 32 is monitored by means of an air cell and vacuum transducer 36. Before reaching the garniture 34, the tobacco stream passes over ecreteur discs 38 which can be raised to trim off excess tobacco, or lowered to leave more tobacco on the band, in order to control the density of the tobacco rod delivered to the garniture 34.

After leaving the ecreteur discs 38, the tobacco meets the cigarette paper 40 at the entrance to the garniture 34. The tobacco is then compressed, a first paper fold is made, and adhesive is applied to one edge of the paper. Following application of the adhesive, the paper is lap folded and sealed by a heater.

The completed cigarette rod passes a density gauge 42, which is normally a radiation-type density sensor, for example model 7000 Micro Plus manufactured by ABB Industrial Systems, Inc., where the density is electronically monitored. Any deviation from standard density is fed back to a weight control system 44, which electro-mechanically adjusts the height of the ecreteur discs 38 to make a correction.

After passing the density gauge 42, the tobacco rod passes into a cutting unit 46 where it is cut into individual cigarette lengths. The cigarettes are then transferred from the cigarette maker to the next production step, e.g., to apparatus for attaching a filter.

A preferred embodiment of the present invention further includes a micro-computer system 50 and a shaft encoder 48, which are described further below. The microcomputer 50 receives the output signals from the density gauge 42 and the air cell transducer 36. The location of these inputs serves to isolate the rotating or moving mechanical components of the cigarette maker into two sections, the hopper/suction band and the ecreteur/garniture sections. However, tobacco stream measurements from other areas could be added to expand the system.

The density gauge 42 provides a voltage output which is approximately the logarithmic inverse of the tobacco process weight. The voltage signal may be converted to tobacco weight using the formula, $$PW=C1-(C2\times Ln(X))$$

where PW is the process weight, C1 and C2 are constants, and X is the voltage output of the density gauge.

The air cell vacuum transducer 36 is preferably a model 142PC01D manufactured by Micro Switch, which provides a voltage output which is proportional to the amount of tobacco under it. An increase in the amount of tobacco carried under the air cell by the suction band will cause an increase in the voltage output of the transducer.

Figure 2:
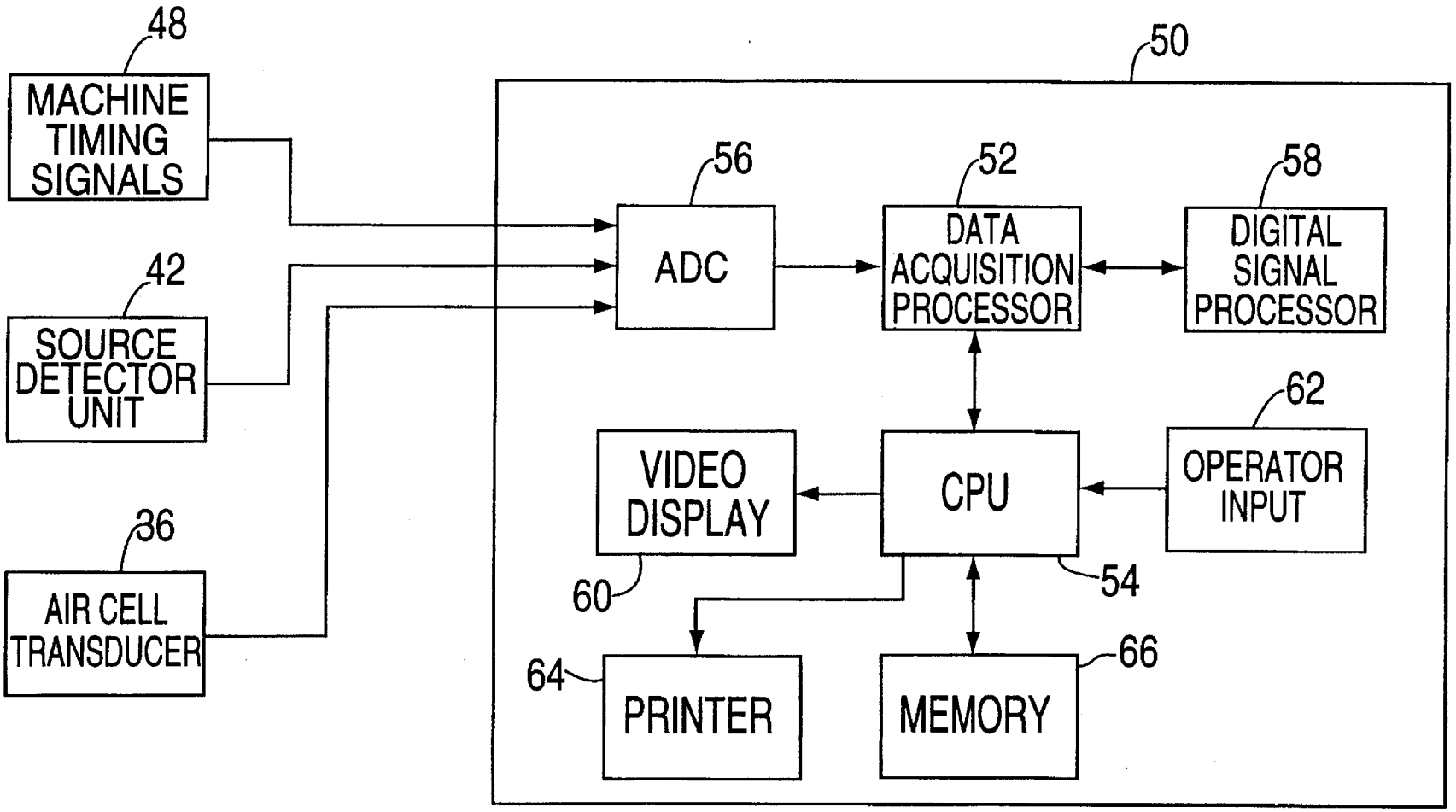
FIG. 2 is a block diagram of the cigarette maker electronic interface and the micro-computer system according to the invention.

Referring to FIG. 2, the computer system 50 is comprised of a data acquisition processor 52, a central processing unit (CPU) 54, and memory 66 (which may include both random access memory and a hard disk). The data acquisition processor 52 includes an analog-to-digital convertor ("ADC") 56 and a digital signal processor 58. By way of example, the CPU 54 is a general purpose Intel 486-type IBM PC-compatible computer chip. The data acquisition processor 52 is preferably a model DAP 2400/6 manufactured by Microstar Laboratories, which contains a Motorola 56001 digital signal process (DSP chip), and is programmed independently of the CPU using its own multi-tasking operating system to perform FFT analysis. The processor 52 may also be programmed to perform other real time data analyses, as discussed below, which are transferred to the CPU over binary communication pipes for further processing and display. The computer system 50 also preferably includes a video display 60, a keyboard interface 62, and a printer 64.

The shaft encoder 48 is mechanically coupled to the cigarette maker and synchronized to the cigarette cutting knife 46 to provide timing signals to the computer 50. Each revolution of the shaft encoder 48 corresponds to the making of two cigarettes. During a single revolution, the encoder generates one index pulse and forty-eight (48) subsegment pulses. The first subsegment pulse is generated simultaneously with the index pulse, and the index pulse and the first subsegment pulse correspond to the beginning of a cigarette pair.

Subsegment pulses are used to trigger twenty-four (24) readings of an analog-to-digital convertor (ADC) per cigarette. On each subsegment pulse, the ADC 14 makes one scan of the density gauge 12 and the air cell transducer 13. The index pulse provides synchronization between the cigarette maker and the computer system 20.

The ADC 56 converts the analog voltage signals to digital values which are then mathematically processed by the digital signal processor 58 to provide real time statistical information concerning the tobacco rod. The data acquisition processor 52 then sends the information to the CPU 54 for further processing and presentation through the video display 60.

More specifically, in accordance with the invention, the digital signal processor 58 performs an FFT spectral analysis on the rod density readings and air cell readings, so as to determine how the tobacco weight varies over time, at various harmonic frequencies, at two different locations in the machine, i.e., the suction band and the finished rod. The processor 58 also calculates the following real time statistical process data:

1) Group Weights. The average weight of the last 1024 cigarettes, updated every 256 cigarettes;
2) Standard deviation of group weight;
3) Group Air Cell. The average air cell reading of the last 1024 cigarettes updated every 256 cigarettes;
4) Standard deviation of group air cell readings;
5) Average of group weight and group air cell;
6) Number of cigarettes produced;
7) Percentage and number of light weight reject cigarettes;
8) Weight of the lightest light weight reject; and
9) Average segment profile of the last 1024 cigarettes and air cell readings updated every 1024 cigarettes.

The FFT frequency analysis is used by the system to identify, and to isolate the sources of, abnormal variation in the tobacco rod density. The remaining statistical data is generated to provide personnel with a complete real time overview of cigarette maker performance.

Figure 3:
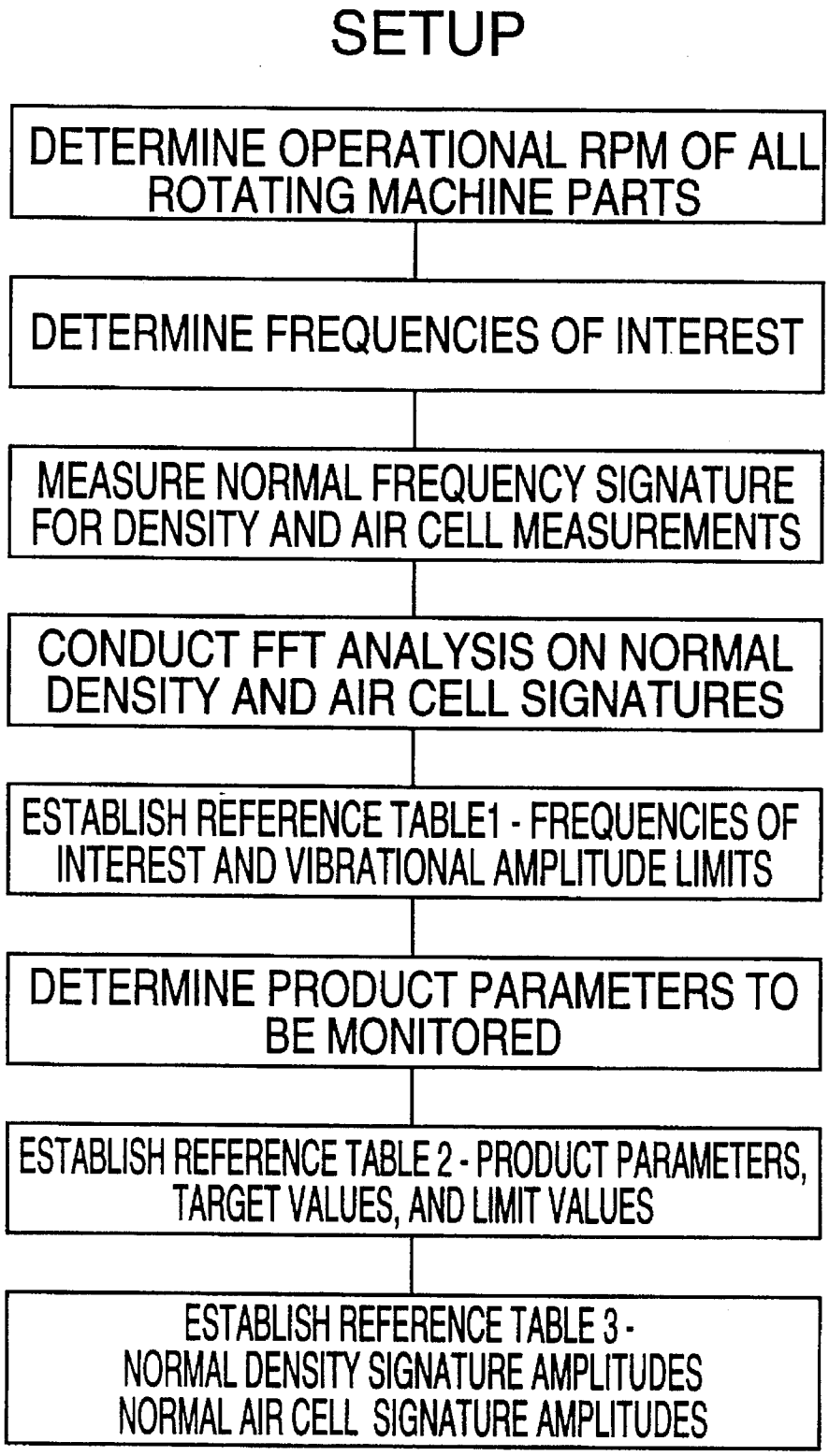
FIG. 3 is a flow chart illustrating a procedure for establishing a reference table in the present invention.

FIG. 3 is a flow chart illustrating a procedure for establishing reference tables used in accordance with the present invention. The operating RPM's of all of the rotating machine parts, frequencies of interest, and vibrational limits at each such frequency are determined. This may be done in the same manner as presently employed in frequency analysis diagnostics. For example, the operating RPM's and frequencies of interest are determined by analyzing the mechanical drive systems of the cigarette maker and hopper systems. Manufacturer's drawings and data sheets on the machine drive systems provide information pertaining to the RPM ratios of all coupled shafts in the machine. The shaft ratio is then applied to the main drive RPM, which is known either by manual or automatic measurement, to calculate the RPM of all other shafts in the drive system.

For example, if the ratio of the driven shaft to the driver shaft is 2:1, and the driver shaft is operating at 3600 RPM, then the driven shaft is operating at 1800 RPM. The frequency harmonics corresponding to such RPM are determined by dividing RPM by 60, and therefore the frequency harmonic representing the 1800 RPM shaft would by 30 Hz. Multiples of the fundamental frequency (e.g., 0.5×, 2×, 3×, 4×, 5× etc.) may also be used.

Once the frequencies of interest are determined, a harmonic amplitude limit is assigned to each such frequency, i.e., the amount of variation of tobacco weight that is deemed acceptable at each frequency (the variation which is acceptable will normally differ for different frequencies). To set the harmonic amplitude limits, 2048 point FFT's are performed on data from each sensor, i.e., suction band air cell and density measurement of the finished rod, on a machine in good working order under normal production conditions. The digital signal processor 58 compiles a running average of the FFT amplitudes at each frequency over a period of approximately 5 minutes to establish a representative average harmonic amplitude level, at each frequency, for each of the two weight measurements. The amplitudes of the previously determined frequencies of interest, i.e., those known to relate to operating mechanical components, are then selected from the averaged FFT data and increased in value by an appropriate amount, depending upon the expected normal deviation. Initially, the amplitude limit may be set to a predetermined amount, e.g., 50% to 100% higher than the normal corresponding average harmonic amplitude. Thereafter, the amplitude limit may be set to a different level depending upon previous experience.

A table of frequencies of interest, together with the corresponding amplitude limits, is compiled, as illustrated in Table 1 below, and stored in memory 66.

TABLE 1

| Component Frequencies/Amplitude Limits | | | |
|---|---|---|---|
| Frequency | Amplitude Limit | Component | Message |
| $f_1$ | $a_1$ | A | action |
| $f_2$ | $a_2$ | B | " |
| $f_3$ | $a_3$ | A | " |
| $f_4$ | $a_4$ | C | " |
| . | . | . | |
| . | . | . | |
| . | . | . | |
| $f_n$ | $a_n$ | N | " |

The message column may contain recommended action relating to the adjustment or replacement of the indicated mechanical components/assemblies or supply additional information which is used to locate and eliminate a mechanical problem.

Various other product parameters which are to be monitored are selected, and target values as well as variation tolerances are determined. In an exemplary embodiment, six main process parameters are monitored at the location of the garniture based on measurements from density gauge 42: individual cigarette weight (which is the sum of 24 subsegment density measurements), 1024 point moving average group weight, standard deviation of the group weight, average of the individual cigarette weights, average of the group weights and average for the group standard deviation.

Six process parameters are also determined at the location of the suction band 32, based on air cell measurements (pressure drop measurement indicating the amount of tobacco on the suction band available to make the cigarette): individual cigarette air cell (sum of 24 subsegments air cell measurements), 1024 point moving average group air cell, standard deviation of the group air cell, average of the individual cigarette air cell, average of the group air cell and average of the group standard deviation. A reference table of such parameters, their target values, and acceptable deviation limits, is compiled, as illustrated below in Table 2, and stored in memory 66.

TABLE 2

| Process Targets and Limits | | |
|---|---|---|
| Process Data | Target | Limit |
| Group Weights | X | ΔX |
| Group Air Cell | Y | ΔY |
| Average Wt & AC | Z | ΔZ |

A baseline frequency signature of the cigarette weight and air cell signals are also taken while the machine is in good working order. The digital signal processor 58 performs 2048 point FFT's over a period of approximately 30 minutes in a peak detection mode, to identify the highest amplitude level, for each frequency in the spectrum, for normal operation. The results are stored in a signature reference table in memory 66, as illustrated below in Table 3.

TABLE 3

| Frequency Signature Of Weight and Air Cell | | | |
|---|---|---|---|
| Rod Weight: | | Air Cell Weight | |
| Frequency | Amplitude | Frequency | Amplitude |
| $f_a$ | $a_a$ | $f_e$ | $a_e$ |
| $f_b$ | $a_b$ | $f_f$ | $a_f$ |
| $f_c$ | $a_c$ | $f_g$ | $a_g$ |
| $f_d$ | $a_d$ | $f_h$ | $a_h$ |
| . | . | . | . |
| . | . | . | . |
| . | . | . | . |
| $f_n$ | $a_n$ | $f_n$ | $a_n$ |

Thus Table 1 contains only some of the frequencies, namely, frequencies that correspond to harmonics of the rotating components of the machine. In Table 1, amplitude limits are assigned at each frequency. The amplitude limit is the normal amplitude at such frequency plus some additional value (i.e., the density can vary somewhat above normal value and still be in limits).

Table 2 contains certain other product measurements and limit values. Table 3 contains the normal amplitude of weight value at all of the frequencies determined by FFT analysis.

Process Monitoring Procedure

Figure 4:
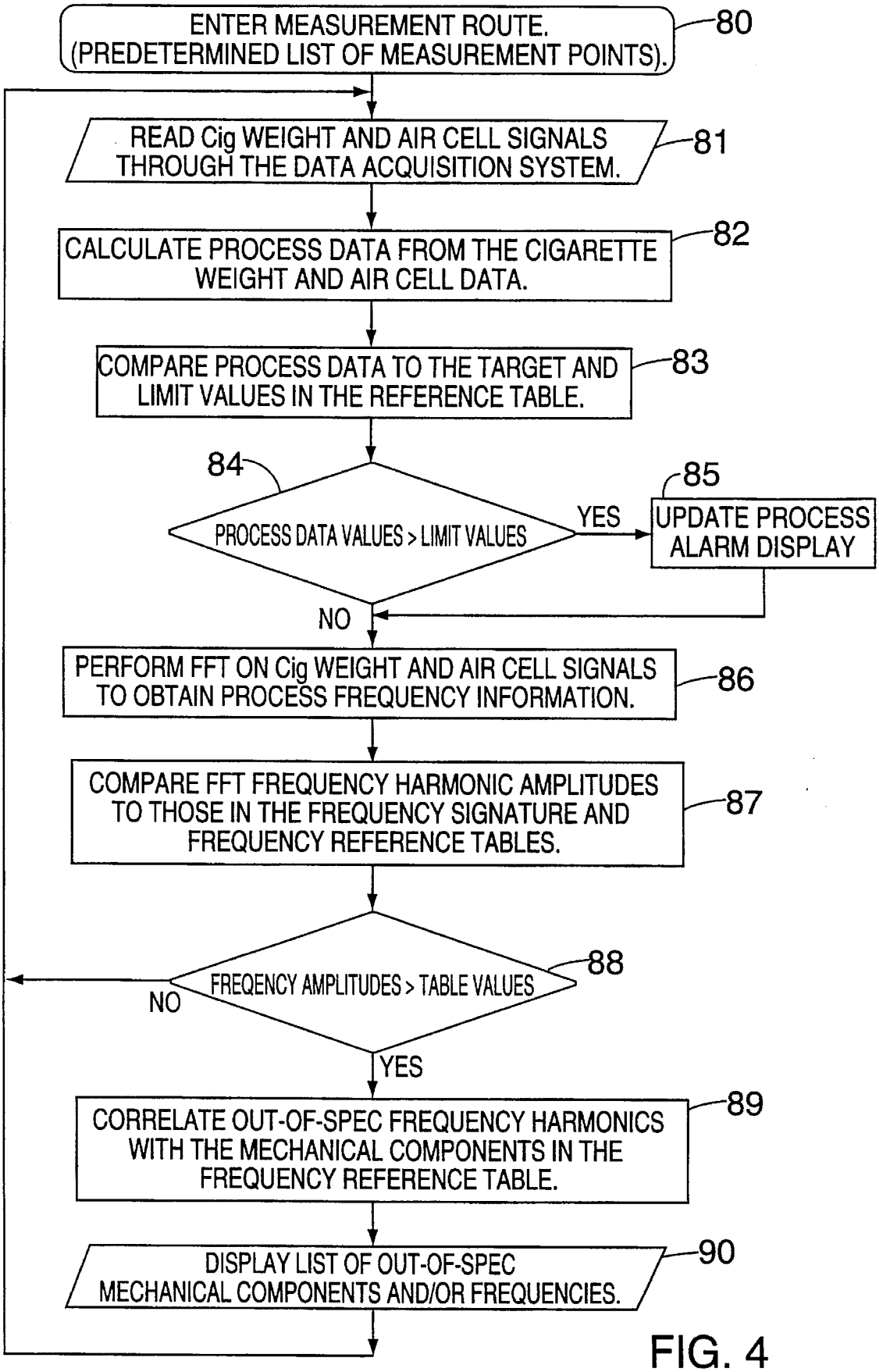
FIG. 4 is a flow chart illustrating the operation of the present invention.

The basic procedure for implementing the present invention is presented in FIG. 4. A route or predetermined list of measurement points is entered. (Step 80). Many different sensors could be included in the route, but for purposes of illustration the route will be limited to the cigarette weight signals from the density detector 42 and air cell transducer 36.

In response to each pulse from encoder 48, the ADC 56 reads a density signal 42 and an air cell transducer signal 36. (Step 81). The ADC 56 converts the signals into digital values and supplies them to the data acquisition processor 52.

At predetermined intervals, e.g., of 256 data points, product data, e.g., 1024 point moving average of cigarette weight and air cell, standard deviation of cigarette weight and air cell, etc., are calculated by the digital signal processor 58 and supplied to the CPU 54. (Step 82). The CPU 54 then compares the measured product data with the target and limit values stored in Table 2. (Step 83). If any of the measured product data exceeds the limits in Table 2 (Step 84), the CPU 54 updates the process monitor alarms and displays on the computer video display 60 (Step 85).

At predetermined intervals, e.g., of 2048 data points, the digital signal processor 58 performs a Fast Fourier Transform analysis on the weight values from the density detector 42 to calculate the amplitude of the deviation at each of 1024 harmonic frequencies. It then performs the same analysis on the air cell transducer values (36), and supplies such information to the CPU 54. (Step 86).

For each of the two measurements, i.e., tobacco rod weight and suction band tobacco weight, the CPU 54 compares the harmonic amplitudes at each frequency to the corresponding harmonic amplitudes in Table 1 (only frequencies related to mechanical components exist in Table 1) and Table 3 (Step 87). If the measurements should exceed the deviation limits of Table 1, or the baseline values of Table 3 (Step 88), the CPU 54 attempts to correlate the out-of-limit harmonic frequencies to the corresponding mechanical components form Table 1 which operate at or have harmonic frequencies equal to the out-of-limit harmonics. (Step 89). The out-of-spec frequencies and amplitudes along with the indicated mechanical components and messages are displayed (Step 90) on the display monitor 60 and/or printer 64. A combination of graphical and tabular displays is preferred. The program then continues the monitoring process.

The monitor or printout preferably indicates whether the amplitude measurement in question is out-of-spec with Table 1, Table 3, or both. Harmonics exceeding the limits of Table 3 indicate process variations that are increasing, i.e., moving up above the baseline signature, and serve primarily to warn of developing problems which do not necessarily require immediate mechanical attention. Harmonics exceeding the limits of Table 1, however, indicate an immediate need for mechanical adjustment or component replacement.

It is possible that the amplitude comparisons to the baseline signature of Table 3 could indicate out-of-limit harmonic frequencies which cannot be correlated to mechanical components in Table 1. This condition will be indicated on the monitor or printout, and suggests a process variation unrelated to machine components or a yet unidentified mechanical condition and the need for further mechanical analysis.

The foregoing represents a preferred embodiment of the invention. Variations and modifications will be apparent to persons skilled in the art, without departing from the inventive principles disclosed herein. All such modifications and variations are intended to be within the scope of the invention, as defined in the following claims.

I claim:

1. A machine for making a product, comprising a plurality of rotatable machine components for supplying a substance in continuous form, detection means for periodically sensing a parameter representative of the supply rate of said substance and for generating signals in response thereto, and a diagnostic system comprising a processor means, wherein said processor means comprises:

means for storing component harmonic frequency values corresponding to rotating frequencies, and harmonics thereof, of rotating machine components;

means for storing said signals from said detection means in digital form;

means for performing a Fast Fourier Transform on a plurality of the stored digitized signals for determining amplitude over a spectrum of frequencies;

means for comparing the calculated amplitude, at preselected frequencies, to a reference value at each such frequency in order to identify out-of-spec amplitude values; and means, responsive to identifying an out-of-spec amplitude value, for matching the frequency corresponding to the out-of-spec amplitude value to a component harmonic frequency value, in order to correlate the out-of-spec amplitude value to one or more rotatable components of the machine, and for generating an error message indicating a possible abnormal condition.

2. A machine according to claim 1, wherein said reference value is a predetermined deviation from a normal amplitude value at each frequency.

3. A machine according to claim 1, wherein said reference value is a normal maximum amplitude value at each frequency.

4. A machine according to claim 1, comprising means for measuring at least one other process value relating to the product, wherein said processor means further comprises means for comparing said other process value to a predetermined limit to identify out-of-spec process values, and means responsive to identifying an out-of-spec process value for matching the frequency corresponding to said out-of-spec process value to a component harmonic frequency value to attempt to correlate said frequency to one or more rotatable elements.

5. A machine according to claim 1, wherein said processor means includes means for storing component harmonic frequency values corresponding to rotating frequencies, and harmonics thereof, of rotating machine components, wherein said preselected frequencies are said component harmonic frequency values, and wherein said processor means further includes means for comparing the calculated amplitude, at each frequency of the spectrum of frequencies, to a second reference value for each frequency for identifying out-of-spec amplitude values.

6. A machine according to claim 5, comprising means for measuring at least one other process value relating to the product, wherein said processor means further comprises means for comparing said other process value to a predetermined limit to identify out-of-spec process values, and means responsive to identifying an out-of-spec process value for matching the frequency corresponding to said out-of-spec process value to a component harmonic frequency value to attempt to correlate said frequency to one or more rotatable elements.

7. A machine according to claim 6, wherein said reference value is a predetermined deviation from a normal amplitude value at each component harmonic frequency value, and wherein said second reference value is a normal maximum amplitude value at each frequency of the spectrum of frequencies.

8. A machine according to claim 7, wherein said processor means includes a first table storing component harmonic frequency values and corresponding amplitude limits and component identifications, a second table storing at least one process parameter and corresponding target and limit values, and a third table storing a spectrum of frequency values and a corresponding normal amplitude value for each frequency.

9. A machine according to claim 1, comprising first and second regulating means for regulating the supply rate of said substance during processing in said machine, wherein said detection means is located between said first and second regulating means, and further comprising second detection means, located downstream of said second regulating means, wherein said processor means includes means for performing an FFT analysis on data from said second detection means and comparing the calculated amplitude, at preselected frequencies, to a reference value at each such frequency in order to identify out-of-spec amplitude values.

10. A machine for making a product, comprising a plurality of rotatable machine components for supplying a substance in continuous form, detection means for periodically sensing a parameter representative of the supply rate of said substance and for generating signals in response thereto, and a diagnostic system comprising a processor means, wherein said processor means comprises:

means for storing component harmonic frequency values corresponding to rotating frequencies, and harmonics thereof, of rotating machine components;

means for storing said signals from said detection means in digital form;

means for performing a Fast Fourier Transform on a plurality of the stored digitized signals for determining amplitude over a spectrum of frequencies;

means for comparing the calculated amplitude, at preselected frequencies, to a reference value at each such frequency in order to identify out-of-spec amplitude values, wherein said preselected frequencies are said component harmonic frequency values;

means, responsive to identifying an out-of-spec amplitude value, for generating an error message indicating a possible abnormal condition; and means for comparing the calculated amplitude, at each frequency of the spectrum of frequencies, to a second reference value for each frequency, and means, responsive to identifying an out-of-spec amplitude value, for generating an error message indicating a possible abnormal condition.

11. A cigarette maker comprising means for supplying a continuous, moving stream of tobacco, at a regulated rate, to a garniture, a garniture for combining said tobacco and cigarette paper to form a continuous tobacco rod, first sensor means for measuring the instantaneous weight of the moving tobacco at a selected location in said machine and for generating signals in response thereto, and a diagnostic system comprising a processor means, wherein said processor means comprises:

means for storing component harmonic frequency values corresponding to rotating frequencies, and harmonics thereof, of rotating machine components of the cigarette maker;

means for storing said signals from said first sensor means in digital form;

means for performing a Fast Fourier Transform on a plurality of the stored digitized signals for determining amplitude over a spectrum of frequencies;

means for comparing the calculated amplitude, at preselected frequencies, to a reference value at each such frequency in order to identify out-of-spec amplitude values; and means, responsive to identifying an out-of-spec amplitude value, for matching the frequency corresponding to the out-of-spec amplitude value to a component harmonic frequency value, in order to correlate the out-of-spec amplitude value to one or more rotatable components of the machine, and for generating an error message indicating a possible abnormal condition.

12. A cigarette maker according to claim 11, wherein said reference value is a predetermined deviation from a normal amplitude value at each frequency.

13. A cigarette maker according to claim 11, wherein said reference value is a normal maximum amplitude value at each frequency.

14. A cigarette maker according to claim 11, wherein said preselected frequencies are said component harmonic frequency values, and wherein said processor means further includes means for comparing the calculated amplitude, at each frequency of the spectrum of frequencies, to a second reference value for each frequency for identifying out-of-spec amplitude values.

15. A cigarette maker according to claim 14, comprising means for measuring at least one other process value relating to the product, wherein said processor means further comprises means for comparing said other process value to a predetermined limit to identify out-of-spec process values, and means responsive to identifying an out-of-spec process value for matching the frequency corresponding to said out-of-spec process value to a component harmonic frequency value to attempt to correlate said frequency to one or more rotatable elements.

16. A cigarette maker according to claim 15, wherein said reference value is a predetermined deviation from a normal amplitude value at each frequency, and wherein said second reference value is a normal maximum amplitude value at each frequency.

17. A cigarette maker according to claim 11, wherein said first sensor means is located upstream of the garniture, and comprising second sensor means, located downstream of the garniture, for measuring instantaneous weight of the tobacco rod, wherein said processor means includes means for performing an FFT analysis on data from said second sensor means and comparing the calculated amplitude, at preselected frequencies, to a reference value at each such frequency in order to identify out-of-spec amplitude values.

18. A cigarette maker according to claim 17, wherein said processor means includes a first table storing component harmonic frequency values and corresponding amplitude limits and component identifications, a second table storing at least one process parameter and corresponding target and limit values, and a third table storing a spectrum of frequency values and a corresponding normal amplitude value for each frequency.

19. A cigarette maker comprising means for supplying a continuous, moving stream of tobacco, at a regulated rate, to a garniture, a garniture for combing said tobacco and cigarette paper to form a continuous tobacco rod, first sensor means for measuring the instantaneous weight of the moving tobacco at a selected location in said machine and for generating signals in response thereto, and a diagnostic system comprising a processor means, wherein said processor means comprises:

means for storing component harmonic frequency values corresponding to rotating frequencies, and harmonics thereo, of rotating machine components of the cigarette maker;

means for storing said signals from said first sensor means in digital form;

means for performing a Fast Fourier Transform on a plurality of the stored digitized signals for determining amplitude over a spectrum of frequencies;

means for comparing the calculated amplitude, at preselected frequencies, to a reference value at each such frequency in order to identify out-of-spec amplitude values, wherein said preselected frequencies are said component harmonic frequency values;

means, responsive to identifying an out-of-spec amplitude value, for generating an error message indicating possible abnormal condition; and means for comprising the calculated amplitude, at each frequency of the spectrum of frequencies, to a second reference value for each frequency, and means, responsive to identifying an out-of-spec amplitude value, for generating an error message indicating a possible abnormal condition.

20. A cigarette maker according to claim 19, comprising means for measuring at least one other process value relating to the product, wherein said processor means further comprises means for comparing said other process value to a predetermined limit to identify out-of-spec process values, and means responsive to identifying an out-of-spec process value for matching the frequency corresponding to said out-of-spec process value to a component harmonic frequency value to attempt to correlate said frequency to one or more rotatable elements.

21. A method of operating a machine that includes a plurality of rotating machine components for supplying a substance in continuous form, comprising the steps of:

storing component harmonic frequency values corresponding to rotating frequencies, and harmonics thereof, of rotating machine components;

detecting a parameter representative of the instantaneous supply rate of said substance and generating digitized signals in response thereto;

performing a Fast Fourier Transform on a plurality of the stored digitized signals for determining amplitude over a spectrum of frequencies;

comparing the calculated amplitude, at preselected frequencies, to a reference value at each such frequency in order to identify out-of-spec amplitude values; and responsive to identifying an out-of-spec amplitude value, matching the frequency corresponding to the out-of-spec amplitude value to a component harmonic frequency value, in order to correlate the out-of-spec amplitude value to one or more rotatable components of the machine, and generating an error message, in response to identifying an out-of-spec amplitude value, indicating possible abnormal condition.

* * * * *

UNITED STATES PATENT AND TRADEMARK OFFICE

CERTIFICATE OF CORRECTION

PATENT NO. : 5,582,192

DATED : Dec. 10, 1996

INVENTOR(S) : James G. Williams III

It is certified that error appears in the above-identified patent and that said Letters Patent is hereby corrected as shown below:

col. 11, line 52, "combing" should be --combining--;

col. 12, line 1, "thereo" should be --thereof--; and col. 12, line 18, "comprising" should be --comparing--.

Signed and Sealed this

Thirteenth Day of May, 1997

Bruce Lehman

*Attest:*

BRUCE LEHMAN

*Attesting Officer*

*Commissioner of Patents and Trademarks*